US005590841A

United States Patent [19]

Stein et al.

[11] Patent Number: 5,590,841

[45] Date of Patent: Jan. 7, 1997

[54] AGITATOR BALL MILL

[76] Inventors: Juergen Stein, Kurnstrasse 4, Stadtbergen, Germany, 86391; Robert Rosen, Neudekenstrasse 14, Augsburg, Germany, 86199

[21] Appl. No.: 379,691

[22] Filed: Jan. 27, 1995

[30] Foreign Application Priority Data

Jan. 28, 1994 [DE] Germany ..... 44 02 609.9

[51] Int. Cl.[6] ..... B02C 17/16

[52] U.S. Cl. ..... 241/171; 241/172

[58] Field of Search ..... 241/171, 172; 366/279

[56] References Cited

U.S. PATENT DOCUMENTS

| | | | |
|---|---|---|---|
| 4,304,362 | 12/1981 | Bühler . | |
| 4,620,673 | 11/1986 | Canepa et al. . | |
| 4,730,789 | 3/1988 | Geiger . | |
| 4,824,033 | 4/1989 | Buehler . | |
| 4,967,968 | 11/1990 | Vitelli | 241/172 X |
| 5,062,577 | 11/1991 | Schmitt et al. . | |

FOREIGN PATENT DOCUMENTS

| | | |
|---|---|---|
| 0475015 | 3/1992 | European Pat. Off. . |
| 2811899 | 3/1978 | Germany . |
| 3345680 | 12/1983 | Germany . |
| 3716587 | 5/1987 | Germany . |
| 3918092 | 12/1989 | Germany . |
| 4010926 | 10/1991 | Germany . |

*Primary Examiner*—Mark Rosenbaum
*Attorney, Agent, or Firm*—Pennie & Edmonds

[57] ABSTRACT

An agitator ball mill for processing free-flowing products features a horizontally split housing (2*a*, 2*b*) as a grinding bin in which a disc-shaped agitator (1) is arranged to rotate. The product enters the grinding product inlet (17) and flows through an upper disc-shaped grinding chamber (8*a*), an outside deflection zone (10), and a lower disc-shaped grinding chamber (8*b*). At the lower grinding chamber (8*b*), a deflection zone (11) arranged radially to the inside is connected in which the product containing the grinding pearls is deflected to the upper grinding chamber (8*a*). In the area between the deflection zone (11) and the upper grinding chamber (8*a*), a branch channel (13) branches off radially to the inside to the separation zone (14), along which a partial stream of product flows to this separation zone (14) whereas a second partial product stream together with the grinding pearls enters the upper grinding chamber (8*a*).

10 Claims, 2 Drawing Sheets

AGITATOR BALL MILL

DESCRIPTION

During continuous flow through an agitator ball mill, and dependent on both the flow velocity and the viscosity of the product suspension, a drag force forms that has an effect on the grinding media or pearls. This drag force causes the grinding pearls to be carried along with the suspension from the inlet into the grinding zone to the separating element at the outlet. This can lead to the grinding pearls compacting in front of the separating element, which in its turn causes a higher degree of wear and higher risk of blockages. This is especially critical in the case of ultrafine grinding operations with extremely fine grinding pearls and high throughput rates.

Several agitator ball mills are known of that apply the following approach to solving this problem: the entrained grinding pearls are made to circulate in the mill with subsequent return to the grinding zone (DE PS 37 16 587, DE PS 33 45 680, DE PS 28 11 899). The separation zone is located in the vicinity of the rotational axis, usually within the agitator, so that the grinding pearls are kept at a distance from the separating element by centrifugal force.

In order to protect the separating element from impacting grinding pearls, the space between the grinding zone and the separation zone should be as wide as possible. The greater the distance between the flow path of the grinding pearls and the separation zone, the greater is the protection of the separating element against wear and blockages, i.e. the greater the diameter of the agitator, the better are the configuration possibilities for the separation zone and the flow path of the grinding pearls. Installation of the separation zone within the agitator necessitates a pot-like form. This offers the possibility of positioning additional active grinding zones within the agitator, although such internal rotating surfaces are highly susceptible to deposits if arranged at right angles to the centrifugal force.

Added to this is the fact that the accessibility to the grinding elements on the inside of the agitator suffers in the case of slim agitator designs.

As the flow goes through the grinding zones in continuous operation, the grinding pearls are carried along with the product suspension. The magnitude of the drag force is dependent on the size and density of the grinding pearls, on the flow velocity, and on the viscosity of the suspension. This interaction of parameters becomes critical as soon as the throughput and solids concentration are high and the grinding pearls employed are extremely small. The grinding pearls are then transported to the separation zone and are compacted there, which leads to blockages and wear. The grinding pearls should therefore be separated from the exiting product stream before reaching the separation zone and returned to the grinding zone via a recirculation port.

The aim is naturally a complete recirculation of the grinding pearls so that the separating device is no longer required. In a first approach to achieving this aim, the design of the grinding zone and grinding pearl recirculation zone is of the utmost importance. Ideally, one should ensure that before the grinding pearls are separated from the exiting product stream, they are already moving in the direction that they will flow through the grinding zone after recirculation. Whereby it is not the grinding pearls which should be separated out of the product stream, but rather the product suspension which should be filtered out of the grinding pearl stream, because grinding pearls are a lot more difficult to redirect than suspensions. Because the recirculation of the grinding pearls is to take place under utilization of centrifugal force, it is logical that the flow pattern through the grinding zone should also be in this direction, i.e. radially. The invention bases on the knowledge that the best separation effect is achieved when the separated suspension flows contrary to the direction of the grinding pearls, i.e. radially inwards to the separation zone contrary to the direction of centrifugal force.

Uniform circulation of the grinding pearls within the mill is hindered by the force of gravity in that the bulk of the charge sinks to the lower regions of the mill. This effect is very pronounced in mills with a cylindrical agitator and a vertical rotational axis. This also leads to the grinding pearl charge compacting together during a mill standstill so that the mill requires a great deal more motor power to re-start it than is required for the actual grinding operation. The objective should therefore be to design a grinding zone geometry that features the shortest paths possible parallel to the force of gravity.

The task is thus to develop an agitator ball mill of this type equipped with a grinding zone and an agitator that permits the unhindered circulation of the mill charge with little or no influence being exercised by the force of gravity, that offers sufficient space for the configuration of a grinding pearl recirculation system to enable complete grinding pearl separation, and that permits a design which is both easy to clean and maintain.

As shown in the figures, the disc-shaped agitator is attached at the bottom to the vertically arranged drive shaft and is studded with grinding pins. The housing walls opposite the agitator are also equipped with pins and together with the agitator, form two flat, cylindrical grinding chambers. The grinding chambers lie above and below the agitator and are connected with each other at their outermost peripheries by means of a turns-shaped transition section. This transition can be designed to form an additional grinding chamber or a deflection chamber. The preferred type of separating element is a slotted pipe screen with a large cross-sectional surface and arranged coaxially within the hollow drive shaft. An inside deflection zone underneath the separating element connects the two grinding zones. A grinding pearl conveying device that is capable of influencing the grinding pearl circulation can be positioned between the drive shaft and the agitator.

The product suspension is fed into the upper part of the housing in the area of the drive shaft and is unformly distributed as it flows through the ring gap between the shaft and the housing wall. The suspension then flows into the inside area of the upper grinding chamber, where it is homogenised and dispersed at an initial low peripheral speed. The flow pattern in the upper grinding chamber is in radial direction to the outside, whereby the peripheral speed and the residence time both increase. After passing the torus-shaped transition, the suspension reaches the lower grinding chamber and flows through this in a radial direction from the outside in. Comminution takes place in the outside reaches of the two grinding chambers. Connected to the inside area of the lower grinding chamber is a stabilization zone into which the entrained grinding pearls are also conveyed. Within the inside deflection zone, the suspension/grinding pearl mixture is redirected into a radial, outwards flow. After passing the inside deflection zone but before reaching the upper grinding chamber, an initial partial flow of suspension is deflected in a radial, inwards direction and then upwards to the separation zone. Because deflection of the first partial suspension flow occurs in an almost contrary direction to the grinding pearl flow, whereby the grinding pearls maintain their flow direction, the first partial suspension flow reaches the separation zone completely free of grinding pearls. The separating element thus serves merely to protect against loss of grinding pearls during instable operating conditions, e.g. during start-up and shut-down of the mill. During regular operation, the separation zone is completely free of grinding pearls, so that the danger of wear and blockages is reduced to the minimum.

Together with a second partial stream of suspension, the grinding pearls are conveyed without deflection to the upper grinding zone. If a product conveying device is positioned downstream of deflection of the first partial stream but upstream of the inside area of the upper grinding zone, this device then serves to accelerate the second partial stream with the grinding pearls.

Because of the extremely short axial flow paths of the mill charge on both the inside and outside of the area between the two grinding chambers, distribution of the grinding pearls within the grinding chambers is governed almost exclusively by flow and centrifugal forces, and not by gravity. The rotation of the agitator exercises a radial force in outwards direction on the grinding pearls, causing them to concentrate in the external area of the grinding chambers, where because of, among other things, the high peripheral speeds, most of the grinding energy is converted, The grinding pearl charge is, however, only compacted here minimally, because the radial forces are weakened by the grinding pearls being braked by the grinding pins of the housing. The distribution of the grinding pearls in the grinding chambers and the grinding pearl circulation is therefore predominantly dictated by the drag force of the product suspension. A grinding pearl conveying device supports this flow mechanism and also lessens the danger of the incoming product suspension forming a short-cut flow on its way to the separation zone.

The short axial grinding zone areas also have the effect of distributing the grinding pearls extremely uniformly as the mill slows down so that almost no gravity-influenced compaction takes place. The mill can thus be re-started without having to increase the torque, which in its turn reduces the required drive power quite considerably. The shape of the agitator and the grinding chambers has the additional advantage that inside surfaces at right angles to centrifugal force are minimised, which also minimises the danger of any dead spaces forming.

Instead of a slotted pipe screen as the separating element, a rotating deflector wheel can be installed, which serves to classify the exiting product suspension by particle size. The deflector wheel is inserted into the mill from below as a complete unit with bearing and drive. The deflector wheel can either run freely within the hollow space of the agitator's drive shaft or can be additionally enclosed in a tightly fitting housing. The product suspension flows from the branch-off after the inside deflection zone to the deflector wheel. Particles which are fine enough pass through the wheel together with the liquid and are discharged via the hollow drive shaft of the classifier and a fines collector. The rejected coarse particles admix with the suspension/grinding pearl stream and are returned to the grinding zone.

Design examples are detailed below with the aid of the appended drawings.

Figure 1:
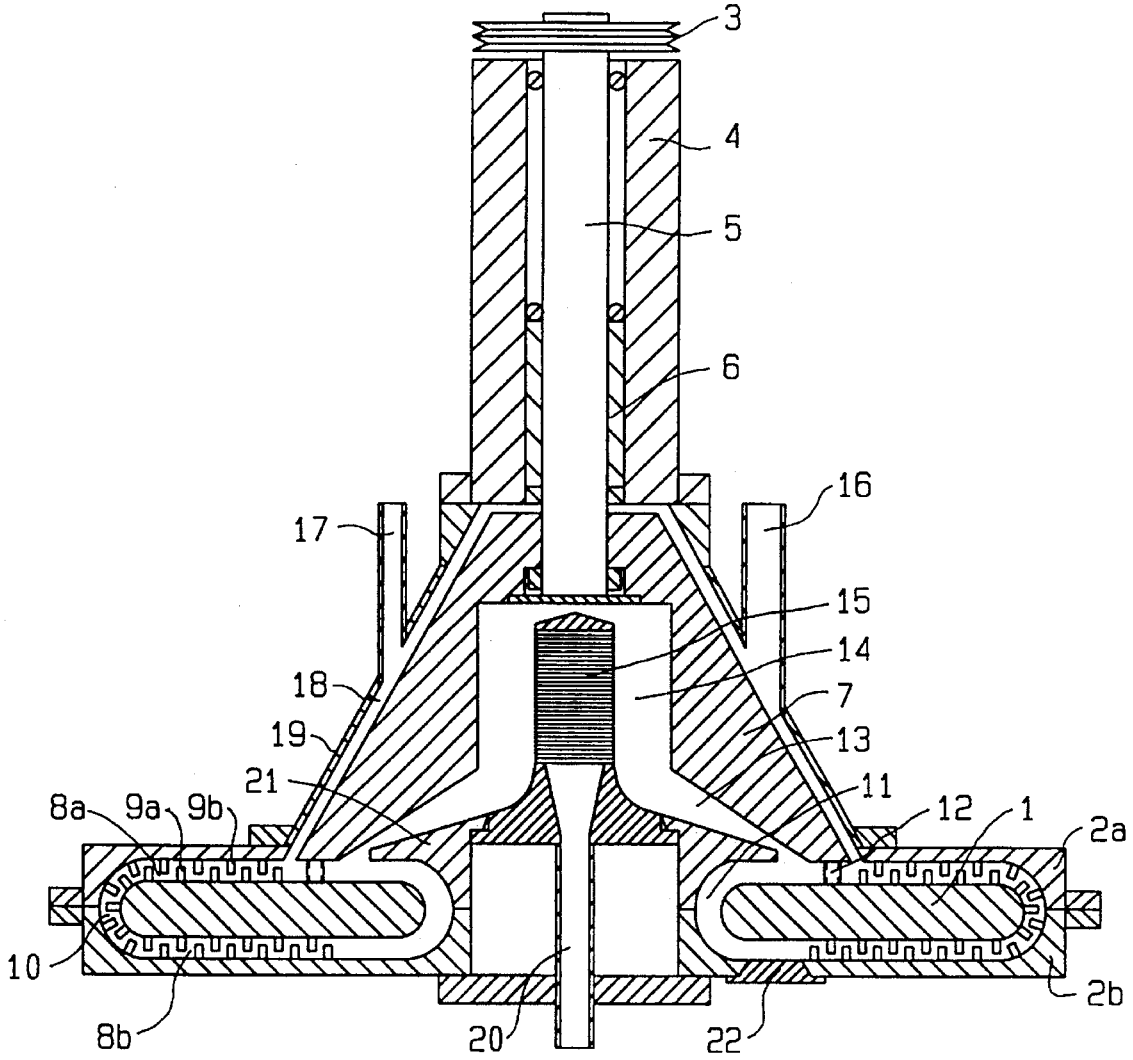
FIG. 1 shows a vertical section of a first design.

FIG. 1 shows the first design example of an agitator ball mill fur free-flowing products. The agitator 1 is disc-shaped and is arranged in a horizontally separable housing 2*a*, 2*b*. The rotational axis is vertical; the drive 3, the bearing 4, the drive shaft 5, and the shaft gasket 6 all lie above the actual mill. The agitator 1 is fastened by means of bolts 12 and a connection flange 7 to the drive shaft 5. The upper grinding chamber 8*a* and the lower grinding chamber 8*b* are located between the housing walls and the top surface of the agitator. Both the agitator 1 and the housing walls are equipped with grinding pins 9*a*, 9*b*. A torus-shaped deflection zone 10 connects the two grinding zones 8*a*, 8*b* at their peripheries. The agitator 1 and the housing walls are also studded with grinding pins in the deflection zone 10, so that this deflection zone forms an additional grinding zone. Located at the inside of the grinding chambers 8*a*, 8*b*, is an inside deflection zone 11, in which the mixture of grinding pearls and suspension is deflected radially in outwards direction. The deflection zone 11 runs from the lower level of the lower grinding chamber 8*b* to the upper level of the upper grinding chamber 8*a*. An initial partial stream of product suspension is deflected to a branch channel 13 and into the separation zone 14, which is located on the inside of the connection flange 7. This branch channel 13 runs radially to the inside at an angle of less than 90° to the horizontal, preferably as shown at an acute angle to the connection between the deflection zone 11 and the upper grinding chamber 8*a*.

The separating element 15 located in the cylindrical separation zone 14 is preferably in the form of a slotted pipe screen and is arranged symmetrically to the rotational axis of the agitator 1 above the inside deflection zone 11 in the separation zone 14 and on a level higher than the upper grinding zone 8*a*. A second partial stream of product enters the upper grinding zone 8*a* together with grinding pearls radially in an outwards direction.

The grinding pearls are filled into the mill through the socket 16. The product to be ground is pump-conveyed via the inlet 17 into the gap 18 between the housing top section 19 and the connection flange 7. After flowing through the upper grinding zone 8*a*, the torus-shaped deflection zone 10, the lower grinding zone 8*b*, and the inside deflection zone 11, the first partial stream of product suspension then passes through the branch channel 13, the separation zone 14, and the separating element 15 to exit the mill through the slotted tube 20. The screen support 21 constitutes the stator wall of the inside deflection zone 11 and of the branch channel 13. A cover 22 which serves to empty the mill is located in the lower part 2*b* of the housing.

Figure 2:
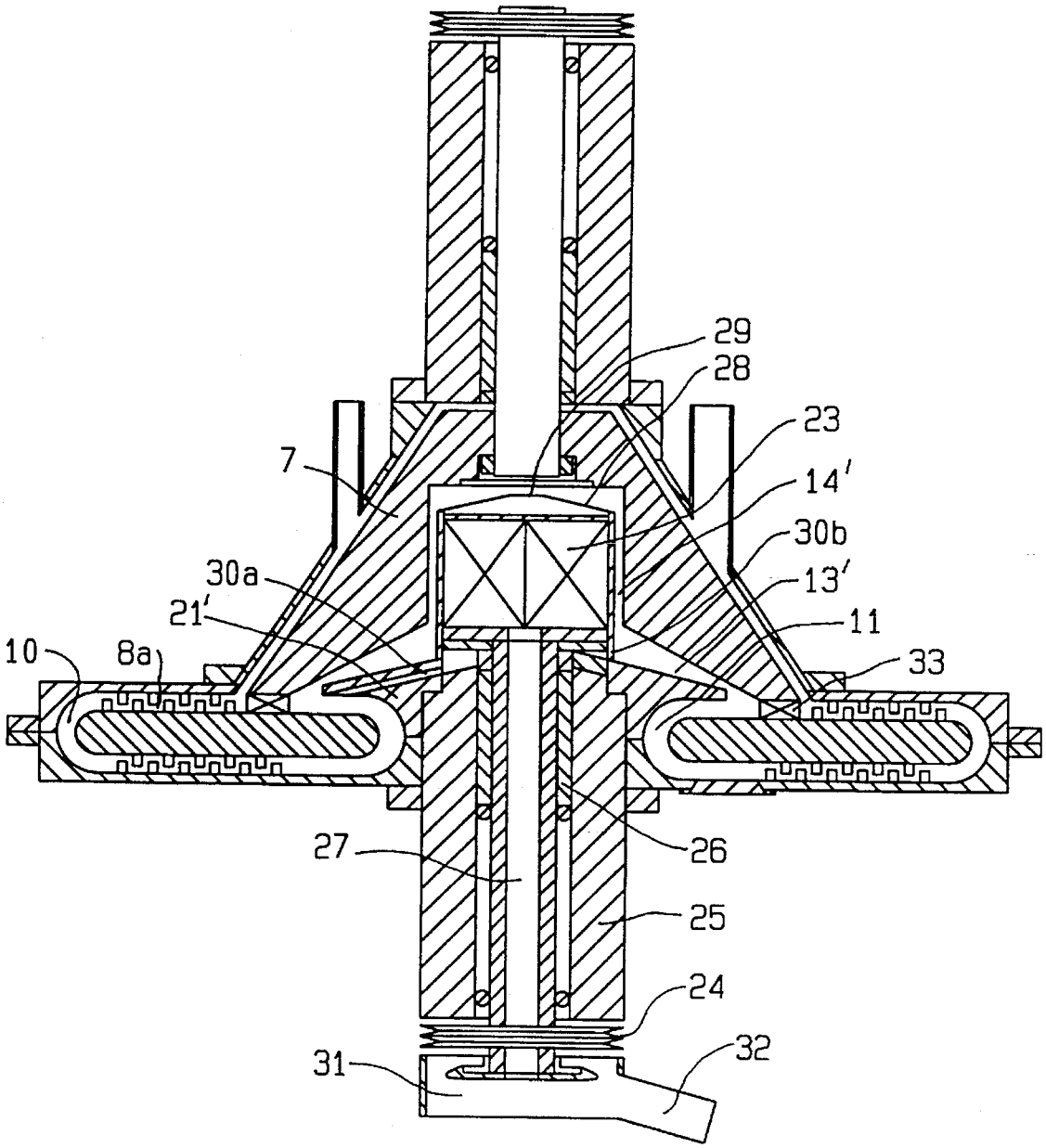
FIG. 2 shows the same vertical section of a second design.

FIG. 2 shows the invention design in the form of a wet classifying mill. Instead of the screen as the separating element 15, a deflector wheel classifier is used here which enables the product to be classified by particle size. Installed in the mill as a complete unit, the classifier constitutes a substitute for the screen insert. The deflector wheel classifier consists of the drive 24, the bearing 25 with shaft packing 26, a hollow shaft 27, and the deflector wheel 23. The deflector wheel 23 runs in a separate classifier housing 28 located in the separation zone 14' within the connection flange 7. After passing through the inside deflection zone 11, the branch channel 13', and the separation zone 14', the product to be classified enters the stationary classifier housing 28 via the upper central opening 29. Coarse particles are rejected by the wheel 23, exit the classifier housing 28 via the coarse material channel 30*a* or 30*b*, and are then recirculated to the upper grinding zone 8*a* by means of a grinding pearl conveying device 33. Two variants for the configuration of the coarse material channels are featured: The coarse material channel 30*a* is installed in the inside stator 21' and returns the coarse material to the end of the inside deflection zone 11, whereas coarse material channel

30*b* is located in the outside wall of the classifier housing 28 and returns the coarse material to branch channel 13'. Fine particles flow through the deflector wheel 23 radially in an outwards direction and leave the machine via the hollow shaft 27, the fines collector 31 and the discharge pipe 32.

The torus-shaped deflection zone 10 featured in the design example shown in FIG. 2 has no grinding pins and therefore does not constitute an additional grinding chamber. Furthermore, between the branch channel 13' and the upper grinding chamber 8*a*, a grinding pearl conveying device 33 for the grinding pearls contained in the second partial stream of product is located which supports radial acceleration in outwards direction towards the upper grinding zone 8*a*; this assists the circulation of the mill contents. This device can consist of radial, tangential, or bent vanes that are mounted beween the connection flange 7 and the agitator 1 as a separate component.

We claim:

1. Agitator ball mill for processing free-flowing materials, consisting of a grinding bin containing a rotating agitator whose surface, together with adjacent housing walls, forms at least one grinding zone having a beginning and an end and through which product suspension and grinding pearls flow, a product inlet on the grinding bin via which the product is fed to the grinding zone, a central separation zone containing a separating element that connects to the end of the grinding zone, and a connection between the end and the beginning of the grinding zone, whereby a first partial stream of product enters the separation zone and a second partial stream of product admixed with grinding pearls enters the beginning of the grinding zone, wherein:

a) the agitator (1) is disc-shaped;

b) the grinding bin is made up of a housing (2*a*, 2*b*) having housing walls located adjacent to said agitator, c) the agitator (1) along with said adjacent housing walls forms an upper and a lower disc-shaped grinding chamber (8*a*, 8*b*) at upper and lower levels, respectively, d) said grinding chambers are connected with one another around the periphery of the agitator (1), with a first zone connected radially to the inside area of the lower grinding chamber (8*b*) to define a first deflection zone (11), into which the product suspension with the grinding pearls is deflected from the level of the lower grinding chamber (8*b*) to the level of the upper grinding chamber (8*a*); and e) a branch channel (13,13') for said first partial product stream extends from between the deflection zone (11) and the upper grinding chamber (8*a*) radially inwardly to said separation zone (14, 14').

2. Agitator ball mill in accordance with claim 1, wherein:

a) the branch channel (13, 13') runs radially inwardly at an acute angle.

3. Agitator ball mill in accordance with claim 1, wherein:

a) seen in a flow direction of the second partial product stream, a grinding pearl conveying device (33) is located between the branch channel (13, 13') and the upper grinding chamber (8*a*).

4. Agitator ball mill in accordance with claim 1, wherein:

a) the connection between the upper and lower grinding chambers (8*a*, 8*b*) at an outermost periphery of the agitator (1) forms an additional grinding chamber.

5. Agitator ball mill in accordance with claim 1, wherein:

b) said upper and lower grinding chambers (8*a*, 8*b*) are connected together with a second zone located at an outermost periphery of the agitator (1) to form a second deflection zone (10).

6. Agitator ball mill in accordance with claim 1, wherein:

a) the agitator (1) is supported by a connection flange (7) whose inside surface forms a truncated cone, to which said separation zone (14, 14') connects, said separation zone being cylindrical and including said separating element (15);

b) next to the truncated cone is an outside surface of a stator (21), also in the form of a truncated cone;

c) the space between said surfaces forms said branch channel (13, 13'); and d) the separating element (15) located in the separation zone (14, 14') is supported by the stator (21).

7. Agitator ball mill in accordance with claim 1 wherein:

a) the agitator (1) is supported by a connection flange (7) with an outside surface in the form of a truncated cone;

b) an upper section (19) of the housing (2*a*, 2*b*) extends in spaced relation to said outside surface to form a gap therebetween; and c) a product inlet (17) extends into said gap (18) formed between said outside surface and said upper section of said housing.

8. Agitator ball mill in accordance with claim 7, wherein:

a) said gap (18) extends into the upper grinding chamber (8*a*).

9. Agitator ball mill in accordance with claim 1, wherein:

a) the separating element is a slotted pipe screen (15).

10. Agitator ball mill in accordance with claim 1, wherein:

a) the separating element is a rotary-driven deflector wheel (23).

* * * * *